US007168917B2

(12) United States Patent
Bronaugh et al.

(10) Patent No.: US 7,168,917 B2
(45) Date of Patent: Jan. 30, 2007

(54) HEAT-GENERATING BLOWER HOUSING

(75) Inventors: David E. Bronaugh, Tyler, TX (US); Stephen S. Hancock, Flint, TX (US); Jay E. Field, Troup, TX (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/729,278

(22) Filed: Dec. 3, 2003

(65) Prior Publication Data

US 2005/0123396 A1 Jun. 9, 2005

(51) Int. Cl.
*F04D 29/40* (2006.01)

(52) U.S. Cl. ..... 415/200; 415/177

(58) Field of Classification Search ..... 415/200, 415/197, 214.1, 177; 392/379, 383–385, 392/360–369; 219/543, 535
See application file for complete search history.

(56) References Cited

U.S. PATENT DOCUMENTS 1,421,221 A 6/1922 Harter
1,948,759 A * 2/1934 Hoffman ..... 392/363
1,991,280 A 2/1935 Hynes
2,053,036 A 9/1936 Jones
2,368,392 A 1/1945 Young
2,856,162 A 10/1958 Adams
2,952,761 A * 9/1960 Smith-Johannsen ..... 219/541
3,211,891 A * 10/1965 Kendall ..... 392/362
4,003,388 A * 1/1977 Nopanen ..... 219/222
4,060,710 A * 11/1977 Reuter et al. ..... 219/548
4,208,644 A * 6/1980 Turner ..... 337/102
4,228,124 A * 10/1980 Kashihara et al. ..... 422/36
4,313,493 A 2/1982 Kawase et al.
4,526,510 A 7/1985 Hoffman et al.
5,484,983 A * 1/1996 Roell ..... 219/545

OTHER PUBLICATIONS

Publication: "The Leader", Title: "New Air Handler Features Better Performance in a Smaller Cabinet", Spring 2004, p. 6, vol. 13, Issue 1.

* cited by examiner

*Primary Examiner*—Ninh H. Nguyen
(74) *Attorney, Agent, or Firm*—William J. Beres; William O'Driscoll

(57) ABSTRACT

A centrifugal blower for a furnace, heat pump, or other type of air handling unit includes a heat-generating blower housing that heats the airflow as the air passes through the blower housing. In some cases, the housing is made of a thermosetting resin impregnated with graphite or co-molded with a graphite cloth. Heat is generated within the housing wall by applying voltage across the housing.

28 Claims, 4 Drawing Sheets

HEAT-GENERATING BLOWER HOUSING

BACKGROUND OF THE INVENTION

1. Field of the Invention

The subject invention generally pertains to fans and more specifically to a heated fan housing.

2. Description of Related Art

Residential and commercial air handling units, such as furnaces, air conditioners, heat pumps, etc., often include a blower or fan that forces air across a heater. Ductwork then conveys the heated air to where it is needed. The heater may be the air handling unit's primary or supplemental source of heat. Often, the heater is simply an electrical resistance heating coil installed at the blower's suction or discharge opening. There are, however, other types of heaters and mounting locations.

A heater can be installed inside the blower housing, outside the blower housing, or at the blower's suction or discharge opening. A heater mounted inside a blower housing is disclosed in U.S. Pat. No. 1,421,221. Although such a design may provide effective heat transfer, the heater appears to disturb or obstruct the airflow significantly.

Heaters mounted outside the blower housing are disclosed in U.S. Pat. Nos. 4,526,510; 2,368,392 and 2,053,036. In each of these cases, the wall of the blower housing creates a detrimental heat shield between the heat source and the air to be heated. Even if the wall of the blower housing were made of a highly thermally conductive material, the blower wall would still provide some thermal resistance. Moreover, a heater mounted outside the blower housing adds additional volume to an air handling unit.

A heater installed at a blower housing's discharge opening is disclosed in U.S. Pat. No. 2,856,162. A heater at such a location impedes the airflow because the heater lies directly across the path of the air.

U.S. Pat. No. 4,313,493 shows a heater that has one portion installed outside the blower housing and another portion extending across the blower's discharge opening. With such an arrangement, the blower wall creates a heat shield between the air and the portion of the heater that is outside the blower housing, and the rest of the heater obstructs the airflow at the blower's discharge opening.

SUMMARY OF THE INVENTION

To avoid obstructing a blower's airflow, to minimize the volume of an air handling unit, and to avoid creating a heat shield between a heater and the air being heated, it is an object of the invention to provide a blower whose blower housing includes a heat-generating housing wall.

Another object of some embodiments is to provide a composite blower housing wall that includes a substrate of an electrically resistant material, such as resin, impregnated with a conductive material such as graphite.

Another object of some embodiments is to provide a multi-layer blower housing wall where one or both surface layers are more electrically conductive than the core layer.

Another object of some embodiments is to provide a blower housing with a layer of graphite cloth.

Another object of some embodiments is to provide a blower housing wall that includes an integral heating element in the form of a wire or ribbon.

Another object of some embodiments is to create a heat-generating blower housing made of an electrically resistant material such as a thermosetting resin.

Another object of some embodiments is to provide a centrifugal blower or an axial fan with a heat-generating housing.

Another object of some embodiments is to provide a heat-generating blower housing whose heat can be varied in discrete increments.

Another object of some embodiments is to provide a heat-generating blower housing whose heat is infinitely variable.

Another object of some embodiments is to use the seam of a blower housing as an electrical node for feeding current to the housing.

Another object of some embodiments is to insulate the exterior surface of a heat-generating blower housing.

Another object of some embodiments is to electrically generate heat within the wall of a blower housing.

Another object of some embodiments is to increase the surface area or mass of a wire or the like electrically generating heat.

One or more of these and/or other objects of the invention are provided by a blower housing that includes a heat-generating housing wall.

BRIEF DESCRIPTIONS OF THE DRAWINGS

DESCRIPTIONS OF THE PREFERRED EMBODIMENT

Figure 1:
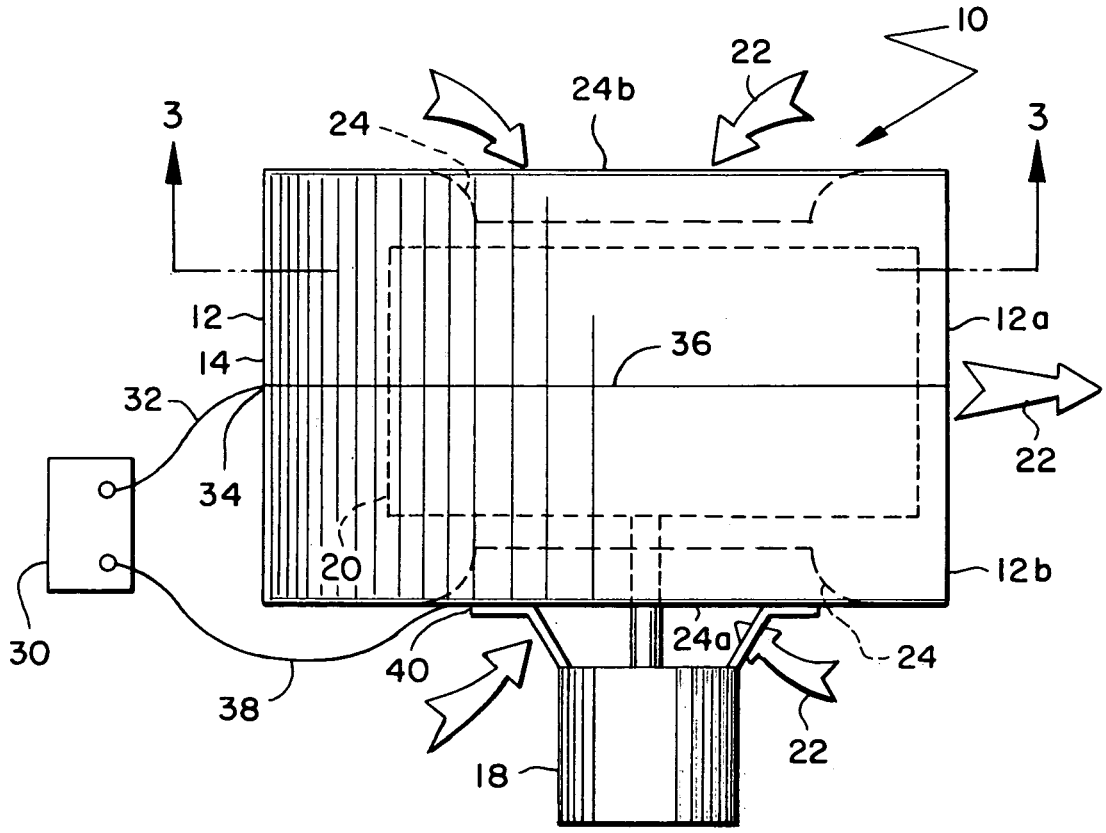
FIG. 1 is a top view of a centrifugal blower that includes a heat-generating blower housing.
Figure 2:
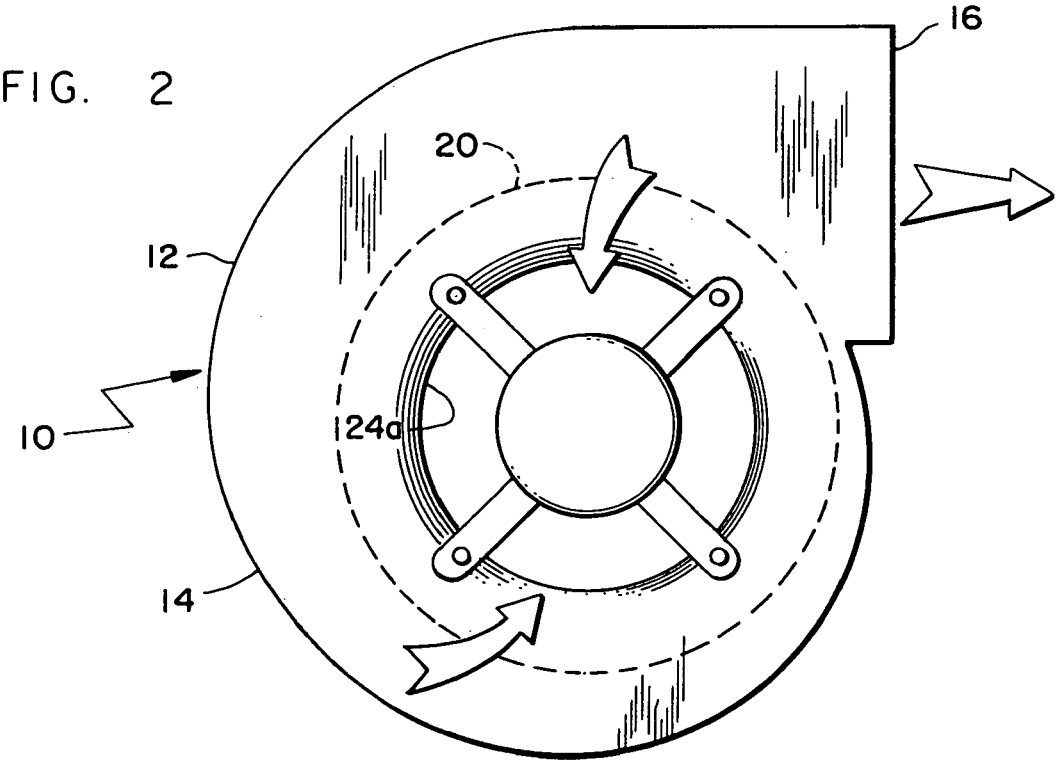
FIG. 2 is a front view of FIG. 1.
Figure 3:
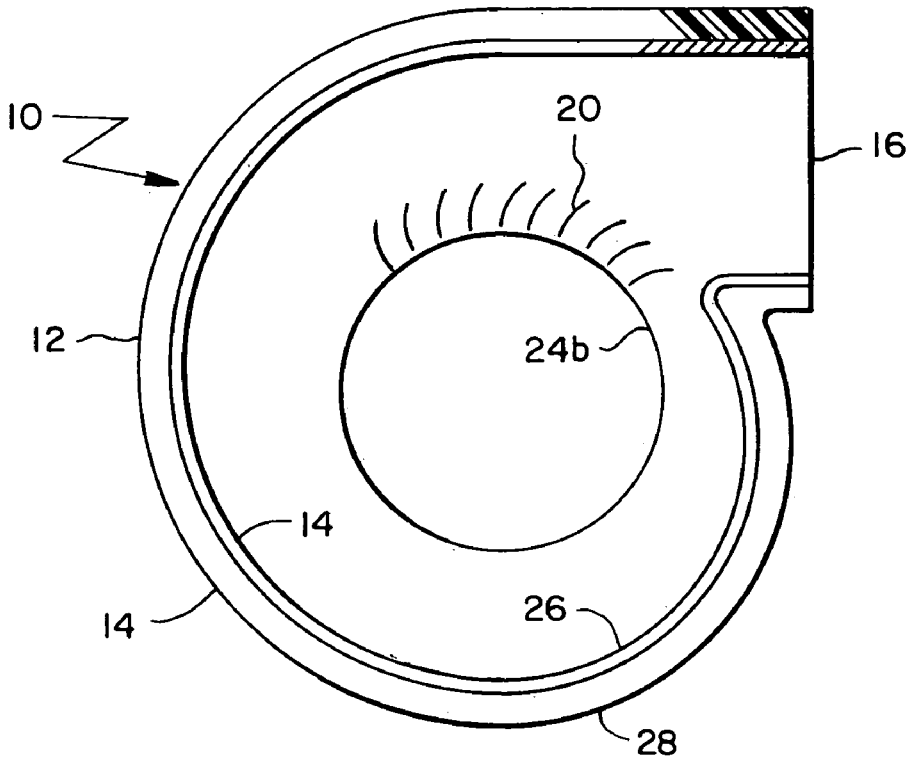
FIG. 3 is a cross-sectional view taken along line 3—3 of FIG. 1.

FIGS. 1–3 show a centrifugal fan or blower 10 whose blower housing 12 includes a heat-generating housing wall 14. Housing 12 defines a suction opening 24 and a discharge opening 16. A motor 18 drives a rotating fan element 20 within housing 12 to move air 22 from suction openings 24*a* and 24*b* to discharge opening 16. The term, "rotating fan element" refers to any rotating member used for moving air. Some examples of a rotating fan element include, but are not limited to, a centrifugal fan wheel and an axial fan blade. The term, "housing wall" refers that part of a fan or blower's structure that helps define the outer peripheral path of a current of air created by the fan, wherein the housing wall lies generally parallel to the airflow path. The term, "heat-generating housing wall" means that heat is created within the housing wall itself (e.g., a heating element lies directly on or within the wall).

In FIG. 3, heat-generating wall 14 is shown comprising an inner layer 26 that is in intimate contact with an outer layer 28. Inner layer 26 is more electrically conductive than outer layer 28. In some cases, for instance, outer layer 28 is a thermosetting resin such as a glass impregnated polyester resin, and inner layer 26 is a graphite cloth such as a 3K, 4×4 twill weave graphite fabric, #1068 by Fibre Glast Developments Corp. of Brookeville, Ohio. Outer layer 28 is preferably a thermosetting resin to withstand the heat generated by inner layer 26. Alternatively, the outer layer 28 may be a material such as stainless steel, which generates heat in response to electric current, and the inner layer may comprise graphite cloth or electric wiring affixed to the outer layer 28.

Heat is generated within wall 14 by connecting an electric power supply 30 to two or more spaced apart points or lines on inner layer 26. For example, one wire 32 can be connected to a node 34 (electrical conductor, connector, terminal, screw, point, wire, etc.) that is adjacent to a seam 36 of blower housing 12, and a second wire 38 can be connected to another node 40. As electrical current travels through housing wall 14 between nodes 34 and 40, the electrical resistance of inner layer 26 generates heat within housing wall 14, which heats air 22.

Producing such a layered or composite blower housing can be achieved in various ways. An adhesive, for instance, could simply bond the inner and outer layers together. A currently preferred method, however, is to co-mold layers 26 and 28 within the same mold cavity, whereby the outer, preferably thermosetting, layer 28 bonds itself to inner layer 26 as outer layer sets within the mold cavity.

To enable the installation of rotating fan element 20, housing 12 is preferably created in two halves 12*a* and 12*b* that connect to each other at seam 36. Seam 36 can be any type of joint including, but not limited to, a butt joint, lap joint, tongue-and groove, flanged joint, snap-in joint, etc. The two halves 12*a* and 12*b* can be held together by its own geometry or by using any of a variety of conventional connecting structure including, but not limited to, spring clips, threaded fasteners, rivets, adhesive, snaps, etc.

Figure 4:
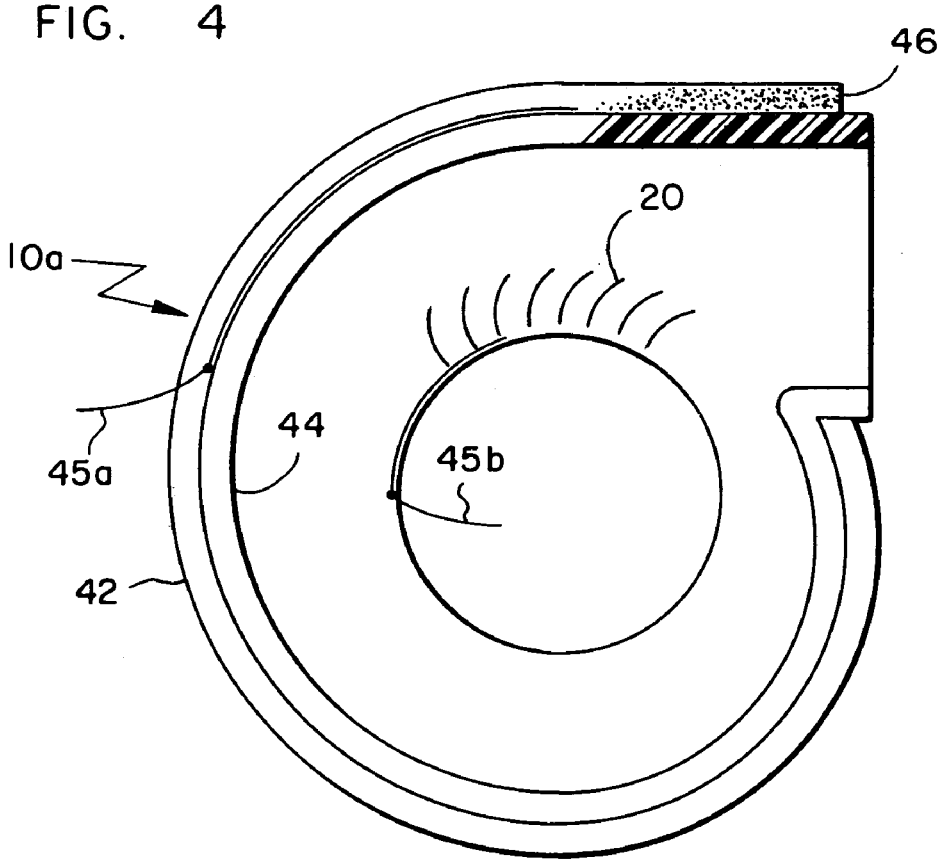
FIG. 4 is cross-sectional view similar to FIG. 3 but of another blower.

For another blower 10*a*, shown in FIG. 4, a blower housing 42 includes a heat-generating housing wall 44 comprising a substantially homogenous material that has the desired electrical resistance to generate heat. Although a variety of materials can be used, in some embodiments the material comprises a resin substrate impregnated with a conductive material that is more electrically conductive than the substrate. The substrate, for example, can be a thermosetting resin such as a polyester resin, and the conductive material can be graphite. Such a combination of materials makes housing wall 44 electrically conductive yet provides wall 44 with an appreciable amount of electrical resistance to generate heat. Alternatively, another electrically resistant material which generates heat in response to the application of electric current may be used and the current may be applied by affixing wiring to the electrically resistant materials surface or by embedding the wiring within the electrically resistant material when that material is formed. Stainless steel is an example of an electrically resistant material which generates heat in response to the application of current. Other suitable material, in addition to the materials mentioned herein, will be apparent to a person of skill in the art.

Heat is generated within wall 44 by connecting power supply 30 in a manner similar to that of blower housing 12. In a currently preferred embodiment, power supply 30 connects to spaced apart nodes that each comprises a wire that is imbedded into wall 44 during the molding process of housing 42. For example, one node or wire 45*a* may lie along seam 36 or suction opening 24*b*, and a second node or wire 45*b* may lie along suction opening 24*a*.

To ensure that most of the generated heat is absorbed by the current of air 22, thermal insulation 46 can cover the outside portion wall 44.

Figure 5:
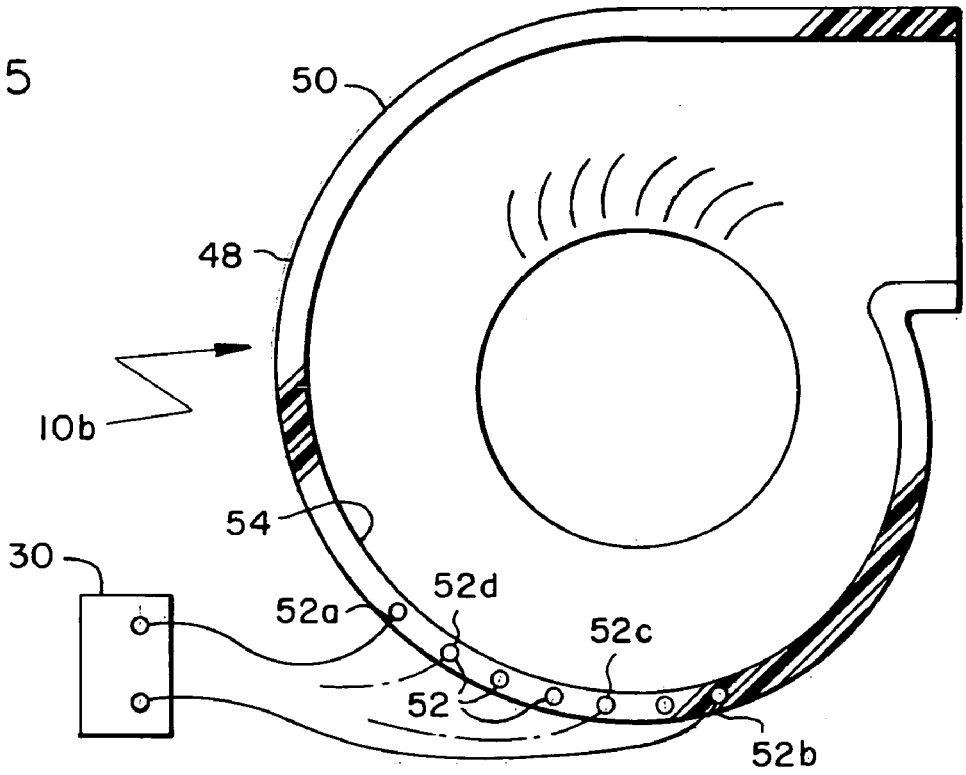
FIG. 5 is a cross-sectional view similar to FIG. 3 but of yet another blower.

For another blower 10*b*, shown in FIG. 5, a blower housing 48 includes a heat-generating wall 50 comprising either a thermosetting resin or a material such as stainless steel which generates heat in response to the application of current. To generate heat within wall 50, a wire 52 (or ribbon) of appreciable electrical resistance (e.g., nichrome wire) lies in intimate contact with wall 50. Wire 52 can be embedded into wall 50 as shown, or wire 52 can be bonded to an inner surface 54 of wall 50 in a manner similar to that used in applying the graphite cloth or inner layer 26. Wire 52 can be laid out in a serpentine pattern (or any other suitable pattern) with opposite ends 52*a* and 52*b* of wire 52 protruding out from wall 50 and connected to power supply 30.

To vary the amount of heat generated within housing walls 14, 44 or 50, power supply 30 can be such that it varies the applied voltage. Power supply 30, for example, can be a variac or other type of voltage controlling device whose output voltage is infinitely variable within a limited voltage range. Additionally, the use of 50 Hertz power will generate less heat than the use of 60 Hertz power. Another way to vary the amount of heat is to connect the power supply 30 at an intermediate point such as 52*c* or 52*d* so that the length of wire 52 receiving current is varied. Clearly, applying electricity between ends 52*a* and 52*b* will generate more heat than applying electricity between end 52*b* and point 52*d* or between and 52*b* and point 52*c*.

Figure 6:
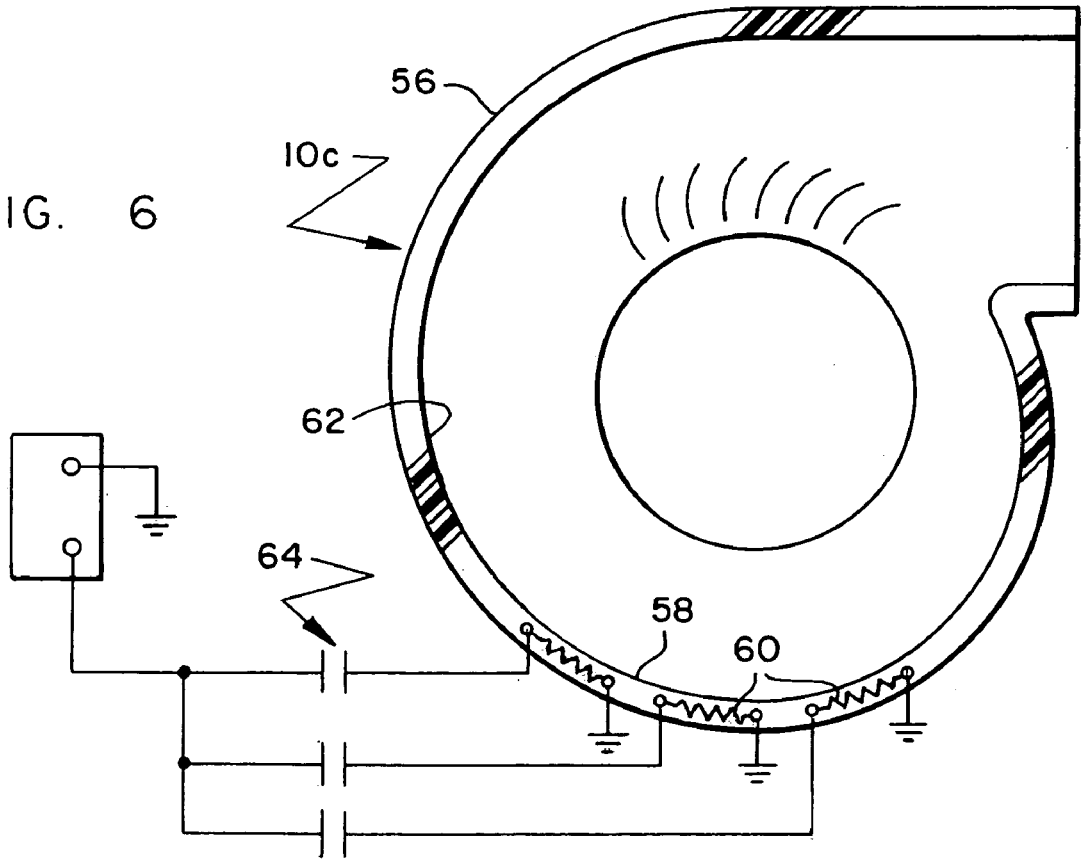
FIG. 6 is a cross-sectional view similar to FIG. 3 but of still yet another blower.

Another way of adjusting the heat output of a blower 10*c* is shown in FIG. 6. Here, a blower housing 56 includes a heat-generating wall 58 that includes two or more electric heating elements 60. Heating elements 60 can lie directly on an inner surface 62 of wall 56 or can be embedded within wall 56. Electrical contacts 64 can selectively energize elements 60 individually for providing discrete levels of heat.

Figure 7:
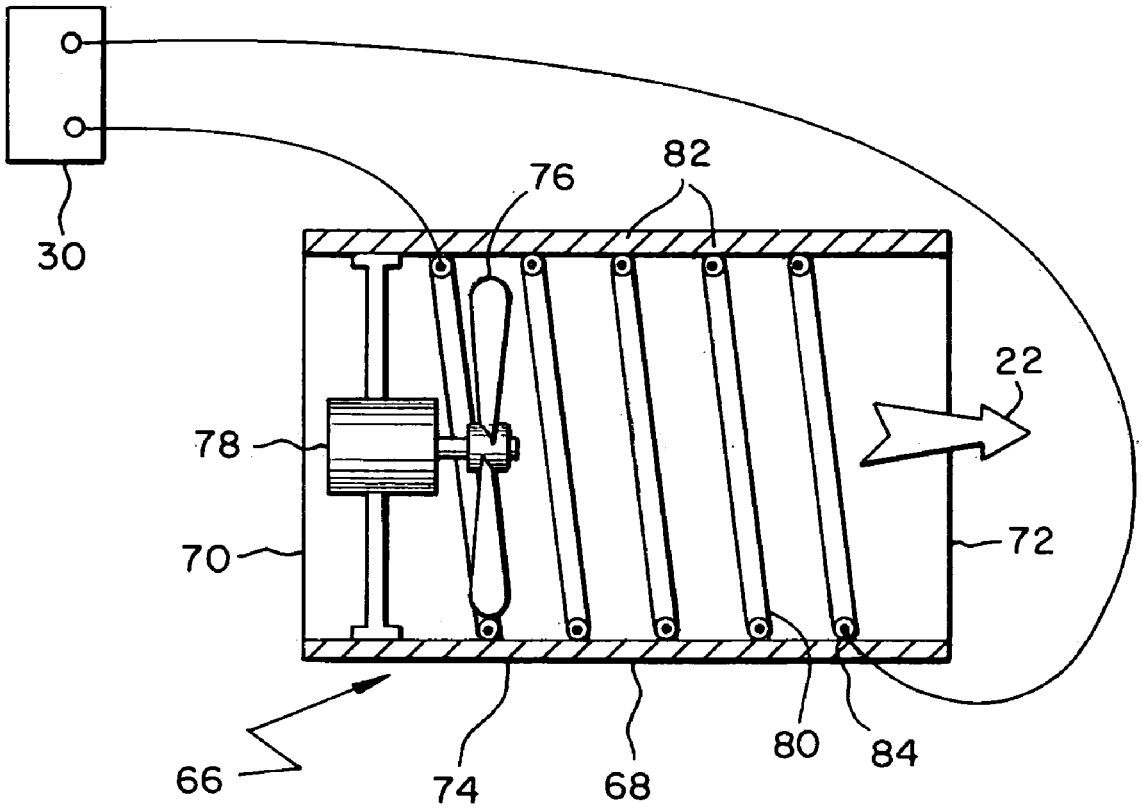
FIG. 7 is a cross-sectional view of axial fan with heat-generating cylindrical blower housing.

A blower 66 of FIG. 7 is an axial fan whose blower housing 68 defines a suction opening 70 and a discharge opening 72. Housing 68 includes a heat-generating housing wall 74 between openings 70 and 72. Blower 66 includes a rotating fan element 76 driven by a motor 78. Wall 74 generates heat by virtue of an electrically conductive wire or ribbon 80 (with appreciable electrical resistance) that lies in a helical pattern on or in wall 74. To generate heat, opposite ends of ribbon 80 connect to power supply 30. The amount of heat generated can be varied by connecting to an intermediate node 82 of the ribbon 80, rather than at 4 on end 84.

Although the invention is described with reference to a preferred embodiment, it should be appreciated by those skilled in the art that other variations are well within the scope of the invention. Although, many of the features (e.g., insulation, materials, wall composition, type of heating element, location of heating element, method of adjusting the heat, etc.) have been illustrated and described with reference to particular blowers, the features can be readily applied to any of blowers 10, 10*a*, 10*b*, 10*c*, and 66. Moreover, the material used to generate heat in response to the application of current may be varied from resin, thermosetting resin or stainless steel to include resistance alloys like nichrome, resistance metals like iron, conductive materials like carbon/graphite and other similar materials. Therefore, the scope of the invention is to be determined by reference to the claims, which follow.

We claim:

1. A blower for creating a current of air, the blower comprising:

a blower housing defining a suction opening and a discharge opening;

a rotating blower element disposed within the blower housing and being in fluid communication with the suction opening and the discharge opening, wherein the rotating blower element forces the current of air from the suction opening to the discharge opening;

a heat-generating housing wall borne by the blower housing and interposed between the suction opening and the discharge opening, wherein the heat-generating housing wall provides electrically generated heat that heats the current of air; and a semiconductive wire lying in intimate contact with the heat-generating housing wall wherein the wire has a first connection, a second connection, and a third connection allowing selective control of the quantity of heat generated by the heat generating housing wall.

2. The blower of claim 1, wherein the heat-generating housing wall comprises a resin substrate impregnated with a conductive material that is more electrically conductive than the resin substrate.

3. The blower of claim 2, wherein the conductive material includes graphite.

4. The blower of claim 1, wherein the heat-generating housing wall comprises an outer layer and an inner layer, wherein the inner layer is more electrically conductive than the outer layer.

5. The blower of claim 4, wherein the inner layer includes a graphite cloth.

6. A blower for creating a current of air, the blower comprising:

a blower housing defining a suction opening and a discharge opening;

a rotating blower element disposed within the blower housing and being in fluid communication with the suction opening and the discharge opening, wherein the rotating blower element forces the current of air from the suction opening to the discharge opening;

a heat-generating housing wall borne by the blower housing and interposed between the suction opening and the discharge opening, wherein the heat-generating housing wall provides electrically generated heat that heats the current of air; and a semiconductive wire lying in intimate contact with the heat-generating housing wall where the wire engages the heat generating housing wall along a length extending from a first point or node to a second point or node.

7. The blower of claim 6 further comprising an intermediate point or node providing a reduced electrical both and a corresponding reduction in the heat generated by the heat generating housing wall.

8. The blower of claim 6, wherein the heat-generating housing wall is comprised of a thermosetting resin.

9. The blower of claim 6, wherein the blower is a centrifugal fan.

10. The blower of claim 6, wherein the blower is an axial fan.

11. The blower of claim 6, wherein the heat-generating housing wall includes a plurality of heating elements that can be selective energized individually for providing discrete levels of heat.

12. The blower of claim 6, wherein the heat-generating wall can generate infinitely adjustable levels of heat.

13. The blower of claim 6, wherein the blower housing comprises at least two sections that are joined at a seam, and the blower further comprises an electrical node adjacent to the seam for providing electrical power to the heat-generating housing wall.

14. A blower for creating a current of air, the blower comprising:

a blower housing defining a suction opening and a discharge opening;

a rotating blower element disposed within the blower housing and being in fluid communication with the suction opening and the discharge opening, wherein the rotating blower element forces the current of air from the suction opening to the discharge opening;

a heat-generating housing wall borne by the blower housing and interposed between the suction opening and the discharge opening, wherein the heat-generating housing wall provides electrically generated heat that heats the current of air; and thermal insulation on the heat-generating housing wall to reduce heat losses therethrough.

15. The blower of claim 14 including a plurality of connections to selectively apply electricity to the heat generating housing.

16. The blower of claim 14 wherein the heat generating housing wall includes a material which is stainless steel or thermosetting resin.

17. A blower for creating a current of air, the blower comprising:

a blower housing defining a suction opening and a discharge opening; a rotating blower element disposed within the blower housing and being in fluid communication with the suction opening and the discharge opening, wherein the rotating blower element forces the current of air from the suction opening to the discharge opening;

a heat-generating housing wall comprising a material generating heat in response to the application of current and a conductive material that is more electrically conductive than the thermosetting resin, wherein the heat-generating housing wall is borne by the blower housing, interposed between the suction opening and the discharge opening, and generates heat that heats the current of air;

wherein the conductive material is a wire and where the wire engages the heat generating housing wall along a length extending from a first point or node to a second point or node; and further comprising an intermediate point or node providing both a reduced electrical and a corresponding reduction in the heat generated by the heat generating housing wall.

18. The blower of claim 17 wherein the heat generating material is a thermosetting resin or stainless steel.

19. The blower of claim 17, wherein the conductive material includes graphite.

20. The blower of claim 17, wherein the conductive material includes a nickel and chromium alloy.

21. The blower of claim 17, wherein the heat-generating housing wall comprises an outer layer and an inner layer, wherein the inner layer is more electrically conductive than the outer layer.

22. The blower of claim 17 where the wire engages the heat generating housing wall along a length extending from a first point or node to a second point or node.

23. The blower of claim 17, wherein the conductive material is a ribbon.

24. The blower of claim 17, wherein the blower is a centrifugal fan.

25. The blower of claim 17, wherein the blower is an axial fan.

26. The blower of claim 17, wherein the heat-generating wall can generate infinitely adjustable levels of heat.

27. The blower of claim 17, wherein the blower housing comprises at least two sections that are joined at a seam, and the blower further comprises an electrical node adjacent to the seam for providing electrical power to the heat-generating housing wall.

28. A blower for creating a current of air, the blower comprising:

a blower housing defining, a suction opening and a discharge opening;

a rotating blower element disposed within the blower housing and being in fluid communication with the suction opening and the discharge opening, wherein the rotating blower element forces the current of air from the suction opening to the discharge opening;

a heat-generating housing wall comprising a material generating heat in response to the application of current and a conductive material that is more electrically conductive than the thermosetting resin, wherein the heat-generating housing wall is borne by the blower housing, interposed between the suction opening and the discharge opening, and generates heat that heats the current of air; and thermal insulation on the heat-generating housing wall to reduce heat losses therethrough.

* * * * *

UNITED STATES PATENT AND TRADEMARK OFFICE

CERTIFICATE OF CORRECTION

PATENT NO. : 7,168,917 B2
APPLICATION NO. : 10/729278
DATED : January 30, 2007
INVENTOR(S) : David E. Bronaugh, Stephen S. Hancock and Jay E. Field It is certified that error appears in the above-identified patent and that said Letters Patent is hereby corrected as shown below:

In The Specification:

Column 2, Line 52, after the word “refers” insert -- to --.

Column 4, Line 25, “between and” should read --between end --.

In The Claims:

Column 5, Line 47
Claim 7, line 2, after the word “both” insert -- path --.

Column 5, Line 47
Claim 7, line 2, after the word “providing” insert -- both --.

Column 6, Line 46
Claim 17, line 23, after the word “electrical” insert -- path --.

Signed and Sealed this

Thirty-first Day of July, 2007

JON W. DUDAS
*Director of the United States Patent and Trademark Office*